US008678914B2

(12) United States Patent
Young

(10) Patent No.: US 8,678,914 B2
(45) Date of Patent: Mar. 25, 2014

(54) GAME INITIATION AND CONTRIBUTION UTILIZING WAGER ON SECONDARY GAME

(75) Inventor: Kent Young, Reno, NV (US)

(73) Assignee: Deforest Fox, LLP, Reno, NV (US)

( * ) Notice: Subject to any disclaimer, the term of this patent is extended or adjusted under 35 U.S.C. 154(b) by 0 days.

(21) Appl. No.: 13/562,462

(22) Filed: Jul. 31, 2012

(65) Prior Publication Data

US 2013/0053127 A1 Feb. 28, 2013

Related U.S. Application Data

(60) Provisional application No. 61/526,381, filed on Aug. 23, 2011.

(51) Int. Cl.
*A63F 9/24* (2006.01)

(52) U.S. Cl.
USPC ..... 463/25; 463/26; 463/27

(58) Field of Classification Search
USPC ..... 463/25–27
See application file for complete search history.

(56) References Cited

U.S. PATENT DOCUMENTS

| | | | | |
|---|---|---|---|---|
| 5,707,286 | A * | 1/1998 | Carlson | 463/16 |
| 6,217,448 | B1 * | 4/2001 | Olsen | 463/25 |
| 6,419,583 | B1 * | 7/2002 | Crumby et al. | 463/42 |
| 2001/0055990 | A1 * | 12/2001 | Acres | 463/25 |
| 2003/0060279 | A1 * | 3/2003 | Torango | 463/27 |
| 2003/0148807 | A1 * | 8/2003 | Acres | 463/26 |
| 2004/0009808 | A1 * | 1/2004 | Gauselmann | 463/25 |
| 2008/0076515 | A1 * | 3/2008 | Baerlocher et al. | 463/20 |
| 2009/0181763 | A1 * | 7/2009 | Wong | 463/25 |
| 2010/0137062 | A1 * | 6/2010 | Luciano et al. | 463/30 |
| 2011/0105219 | A1 * | 5/2011 | Allen et al. | 463/25 |

* cited by examiner

*Primary Examiner* — Lawrence Galka
(74) *Attorney, Agent, or Firm* — Watson Rounds; Marc D. Foodman

(57) ABSTRACT

A gaming system and method for use in one or more casino establishments for offering a secondary game that is initiated separately from a base game and that requires a separate contribution for a player to be eligible to participate in the secondary game. The gaming machine and method are offered on electronic gaming machines such as slot machines and video poker machines, but may also be deployed in other forms such as on a general purpose computing device connected to a network.

21 Claims, 6 Drawing Sheets

GAME INITIATION AND CONTRIBUTION UTILIZING WAGER ON SECONDARY GAME

RELATED APPLICATION INFORMATION

This application claims priority benefit from U.S. Provisional Application No. 61/526,381, filed on Aug. 23, 2011.

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

Electronic gaming machines ("EGMs") offer a variety of games such as slot games, video poker games, roulette games, keno games and other types of wagering games that are commonly deployed at a casino for use by players. Play on the EGMs typically requires the player to place a wager on the outcome of a primary game. On many such EGMs, secondary games or bonus rounds are also available after the player qualifies by attaining a certain winning combination or event on or related to the primary game. The player would then enter the secondary game or bonus round where they have an opportunity to win extra game credits, game tokens or other awards. The player automatically enters the secondary game or bonus round upon achieving a winning game outcome, or alternatively, when a bonus symbol appears in a predetermined position on the reels of a slot game (or the game display of another type of game) upon completion of the game. The player may be awarded credits for winning the base game and then additional credits for winning the secondary or bonus game.

Historically, the format of game play with winning combinations entitling the player to enter a secondary or bonus round has worked well for players and gaming establishments. They generate player excitement and maintain the interest of the player. However, for a player who hits a streak of losses, it may result in the player leaving the game, and possibly the gaming establishment without further play.

During the past few years, overlay screens have been introduced on EGMs. These overlay screens enable new functionality on EGMs including the offering of Application Gaming Technology ("AGT") which is also referred to as "applications" or "apps" that can be offered to a player in a server based gaming environment over a network. The overlay screens are offered by a number of EGM manufacturers and include products such as IGT's Service Window, Bally's iView DM, WMS' Freedom Port, and Aristocrat's Encompass. The overlay is a "subscreen" that appears on an existing video display on the EGM and can be used to offer applications of all types that might be of interest to a player. For example, a player may watch television in an overlay screen while playing a game on the EGM, or that same player may take advantage of a separate and independent bonus game app that may be offered through the overlay screen.

The present invention is a gaming system and method for offering a separate secondary networked game app through the overlay screen. Like other games played on an EGM, the player places a separate initial wager to play the networked app game. The secondary networked app game may be a game including but not limited to any of the following types:

horse racing, bingo, keno, slots, poker, roulette, black jack, craps, baccarat, or any other wagering game. The player is effectively engaged in two different games at the same time—the base game on the EGM and the secondary networked app game that is displayed on the overlay screen on the EGM. Upon winning one or both of the base game and the secondary networked app game, the player is awarded a prize that is transferred to the credit meter on the EGM in the event of a monetary prize.

BRIEF DESCRIPTION OF THE DRAWINGS

For a better understanding of the present invention, and to show more clearly how it functions, reference will now be made, by way of example, to the accompanying drawings. The drawings show embodiments of the present invention in which.

DETAILED DESCRIPTION OF THE INVENTION

Figure 1A:
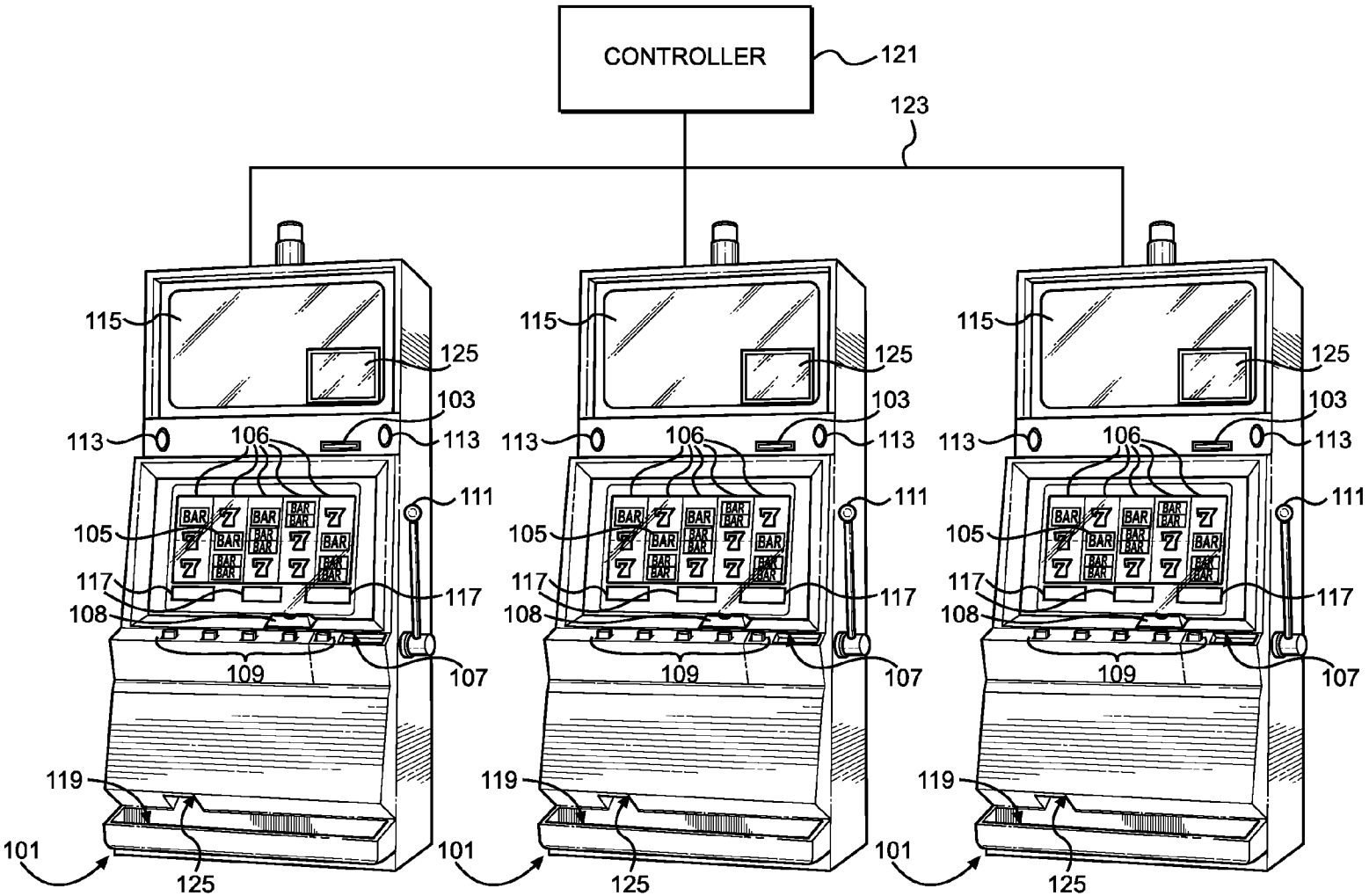
FIG. 1A shows electronic gaming machines for playing a game connected to a network controlled by a server with each electronic gaming machine having an overlay screen.

The present invention will now be described more fully with reference to the accompanying drawings. It should be understood that the invention may be embodied in many different forms and should not be construed as limited to the embodiments set forth herein. Throughout FIGS. 1-5, like elements of the invention are referred to by the same reference numerals for consistency purposes.

FIG. 1A shows a group of electronic gaming machines connected to a central controller. Each EGM 101 is a wagering device that is used in a casino and may be configured to display and play any of a number of different types of games, including but not limited to electromechanical spinning reel type slot games, video reel games, video poker, keno, roulette, craps, blackjack, or any other type of wagering game.

A group of EGMs 101 forms a bank that may be connected together for different types of system applications. For example, a group of EGMs 101 may be linked together for bonusing in a variety of ways, including progressive bonuses where a portion of an amount wagered is applied to a progressive meter that advances as additional games are played. It is also common for EGMs in a casino establishment to be connected to systems for player tracking so that the casino can keep track of the amount of play by each individual player. In that case, each player is issued a player tracking device such as a card that is inserted into a card slot 103 on EGM 101 during play. The card identifies the player to the system and all wagered amounts are tracked for loyalty rewards and other marketing programs of the casino. Other systems connecting EGMs 101 are used for accounting purposes so that a casino operator can monitor and track play, and assess performance of EGMs across the entire casino floor.

Each EGM 101 has a number of components. A main display 105 is used to show game play and resulting outcomes, and may be in the form of a video display (shown), or alternatively, physical reels. Touch screen displays are included on many current EGMs and provide a flexible interface for operation of EGM 101, including displaying symbols 106 during play. Other components include a bill validator and a coin acceptor that are both housed inside EGM 101 into which bills are inserted through bill slot 107 and coins may be inserted through coin head 108, respectively. Buttons 109 on the exterior of EGM 101 are used to control certain EGM operations in conjunction with touch screen display 105. A handle 111 may be used to initiate play of a game and speakers 113 are used to provide sounds in conjunction with game play and other EGM operations. EGMs 101 further include a top box 115 for displaying pay tables, artwork, advertising or other types of information either on fixed glass or on other displays such as an integrated video panel. For purposes of describing the invention, top box 115 is fitted with a liquid crystal display ("LCD") screen to permit aspects of game play from either a base game or a secondary game, as well as other types of information to be shown in top box 115 to players or others viewing top box 115.

Meters 117 for tracking credits available for play and other amounts are positioned near the bottom of screen 105. A coin tray 119 at the bottom of EGM 101 is used to catch coins as they are dispensed to a player. It is also common for EGM 101 to include a ticket-in, ticket-out ("TITO") component that works in conjunction with a bill validator for accepting and printing bar coded tickets that are accepted by the machine and displayed on meters 117 upon a ticket being inserted into bill slot 107.

All operational functions of EGM 101 are controlled by a controller such as a microprocessor (not shown) housed inside EGM 101. The controller executes instructions that include operation of a random number generator ("RNG") that is known to those of ordinary skill in the art. Game outcomes are determined based on the results corresponding to the numbers selected by the RNG.

Figure 2A:
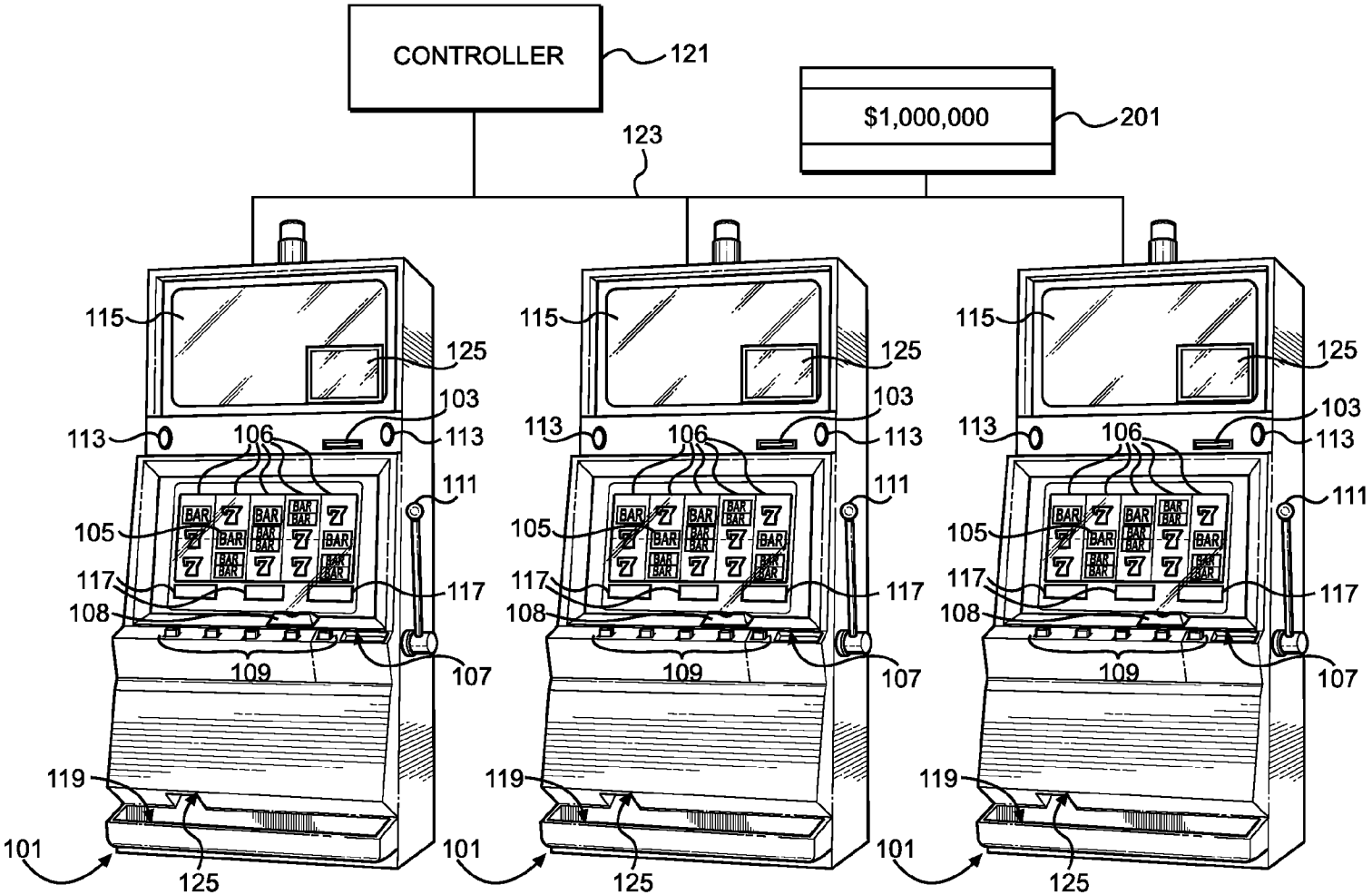
FIG. 2A shows electronic gaming machines for playing a game connected to a network controlled by a server with an overlay screen and a shared display for displaying results of a secondary networked app game to a broad audience of casino patrons.

In the system of FIG. 1A, EGMs 101 are connected to a controller 121 that is used to interface with EGMs 101 to perform a number of different functions, depending on how games on EGMs 101 are configured to operate. For example, controller 121 may instruct EGMs 101 to dispense cash bonuses based on winning events on a networked bonus feature such as a bonus game with a prize of $1 million as shown in FIG. 2A. Controller 121 is a microprocessor based device such as a computer or server that is in two-way communication with each of the EGMs 101 in a multi-device system over a network connection 123. Controller 121 receives signals from EGM 101 that may indicate any of a number of different types of events occurring on EGM 101.

A screen overlay 125 is also included in EGM 101. Screen overlay 125 may be enabled to permit controller 121 to display messages or aspects of game play directly on EGM 101. It should be understood that screen overlay 125 may be presented anywhere on the LCD in top box 115. Alternatively, it may be placed for displaying information or game play to a player on main display 105 of EGM 101. In either case, a player is able to be presented with information or game play screens of a secondary networked app game simultaneously with play of the base game.

Figure 1D:
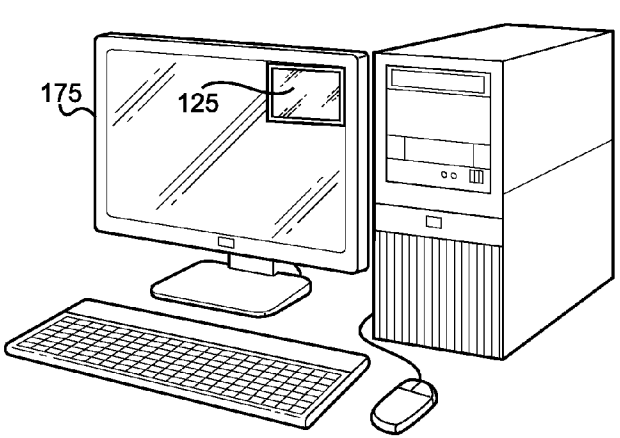
FIGS. 1B-1F show computing devices for playing a game each of which has an overlay screen.
Figure 1C:
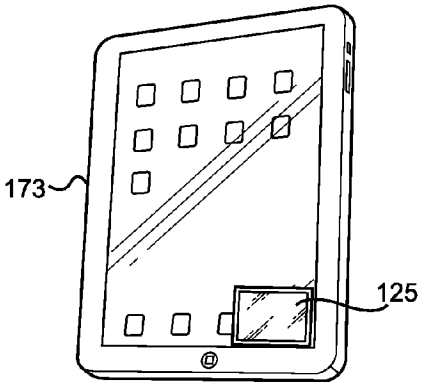
Figure 1B:
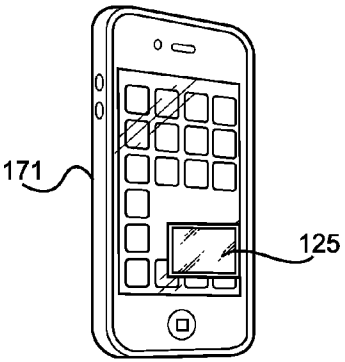
Figure 1E:
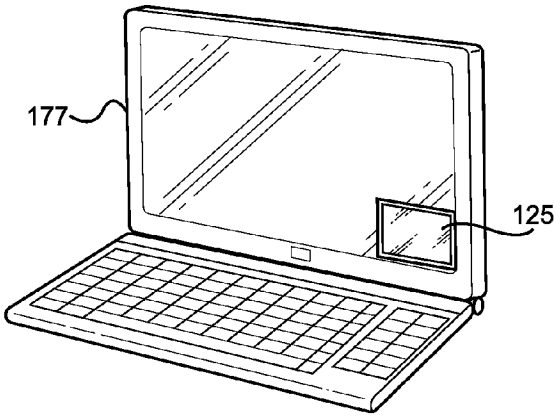
Figure 1F:
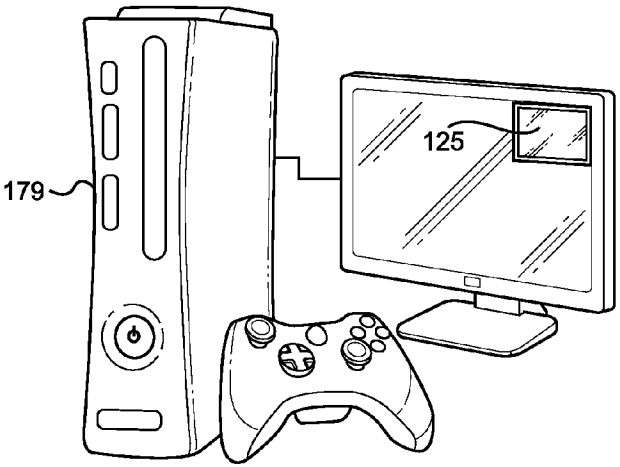

FIGS. 1B-1F show a number of general purpose computing devices which may be used to play a game. These figures show a smartphone 171 in FIG. 1B which may be an Apple iPhone 4S® as pictured, or any other mobile phone type device. A tablet computer 173 is shown in FIG. 1C which may be an Apple iPad 3® as pictured, or any other tablet computing device. A desktop computer 175 is shown in FIG. 1D which may be a Lenovo® machine as pictured, or any other desktop computer. A laptop computer 177 is shown in FIG. 1E which may be a Lenovo® computer or any other laptop computer. And, a home video gaming device 179 is shown in FIG. 1F which may be a Microsoft Xbox® system or any other home video system connected to a screen. Other types of network connected devices could also be used to play games including portable video gaming devices such as a Sony PSP®, a Nintendo GameBoy®, or an internet connected television with a browser or app capabilities. Any of these devices is capable of playing a game, including a wagering game, through an app loaded onto the device or through a website accessible using a browser on the device. In the case of the networked game, payment may be made by credit card, Paypal® or another payment service. The RNG is run securely on server based system 221 and then delivers the outcomes over the internet to be displayed on the general purpose computing device. Each of these devices is also capable of displaying an overlay screen 125 with operation that works in a manner that is the same as or similar to each EGM 101 of FIG. 1A FIG. 2A shows a group of EGMs 101 and controller 121 connected on network 123 along with a central display 201. Central display 201 may be a separate large flat panel display for indicating the awarding of large or special prizes to a player in the secondary networked app game. Central display 201 may also provide a final prize selection for a secondary networked app game winner is in the form of a wheel (not shown) with different potential winning outcome amounts shown on it. Central display 201 may alternatively be incorporated in the housing of EGM 101 such as in top box 115, or it may be a separate device situated nearby to EGM 101 and shared by more than one EGM 101 so that it may be displayed prominently for visitors to a casino establishment to see thereby raising the excitement level for the player playing and the other casino customers. Central display device 201 may take the form of any bonus indicator, a variety of which are known, including but not limited to reels, "pick a prize" reveal type bonus indicators, timers, arrows, etc. Central display device 201 may also be in the form of a dedicated device specifically designed for a particular type of secondary networked app game, such as a physical wheel with multiple potential outcomes.

In FIG. 2A, EGM 101 is shown as a casino gaming device of the type depicted in FIG. 1A. It should be understood that any one or more of the general purpose computing devices of FIG. 1B-1F—smartphone 171, tablet computer 173, desktop computer 175, laptop computer 177, or home video gaming system 179 shown in FIGS. 1B-1F—could be placed on a network connected to server based system 221 and used to deliver a game as described herein. For purposes of this specification, reference to one or more EGMs 101 in an environment using a limited access intranet of the type typically found in a casino would also apply to one or more general purpose computing devices with a secure connection to a server over the internet and not involving a physical casino property at all, and which may or may not require a wager or payment to play.

Figure 2B:
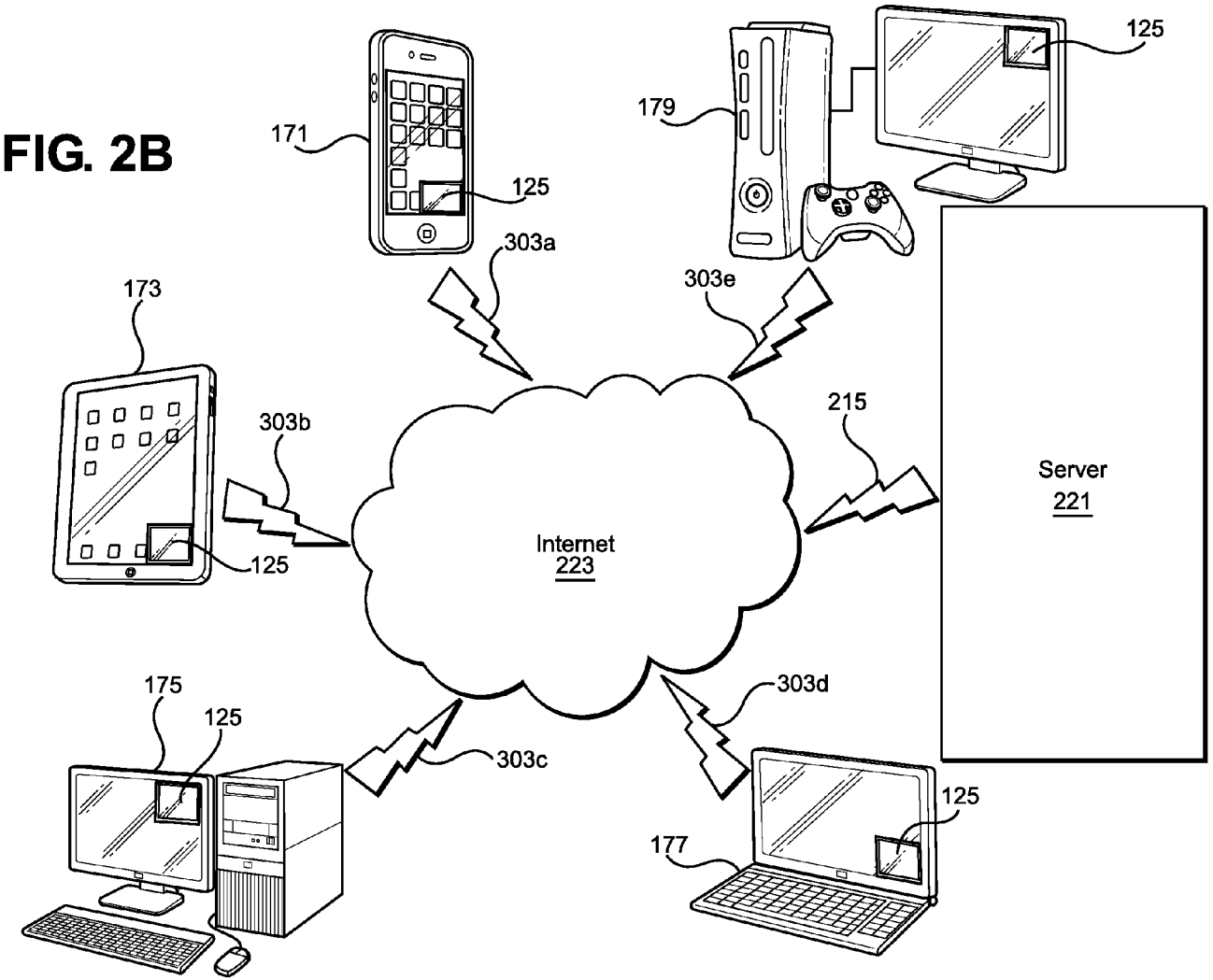
FIG. 2B shows a group of electronic gaming machines on a network connected to a server.

FIG. 2B shows server based system 221 connected to a network with multiple computing devices for playing games.

It should be understood that the network shown in FIG. 2B operates in a manner similar to the network of FIG. 2A, except that the computing devices on the network of FIG. 2B are connected over the internet 223 with each device 171-179 connected over a secure connection 225*a-e* to server based system 221 which connects to internet 223 over network connection 227. Payments can be made securely over internet 223 using connections 225*a-e*, and then delivered to an operator over connection 227. Similarly, the game is executed on server based system 221 using a secure RNG with the outcomes being delivered to the individual devices 171-179 over internet 223. Alternatively, the game software or a portion of it may be resident and executed on each device 171-179. Wagers by players and payments to players may be made using accounts set up with an operator of a website on which the games are run. For each device 171-179, an overlay screen 125 may be used to display the secondary networked application game.

It will be understood that the type of network over which data is communicated can be one of several different types of networks. These networks include a Local Area Network (LAN), Wide Area Network (WAN), an intranet or the Internet. Other proprietary networks could also be used without departing from the principles of the invention. This would include such networks as a Windows network or an Ethernet network.

Overlay screen 125 on computing devices 171-179 does not need to be a separate screen. Instead it can be implemented as a picture-in-picture ("PIP") and as shown on each of devices 171-179 in FIG. 2B.

Figure 3:
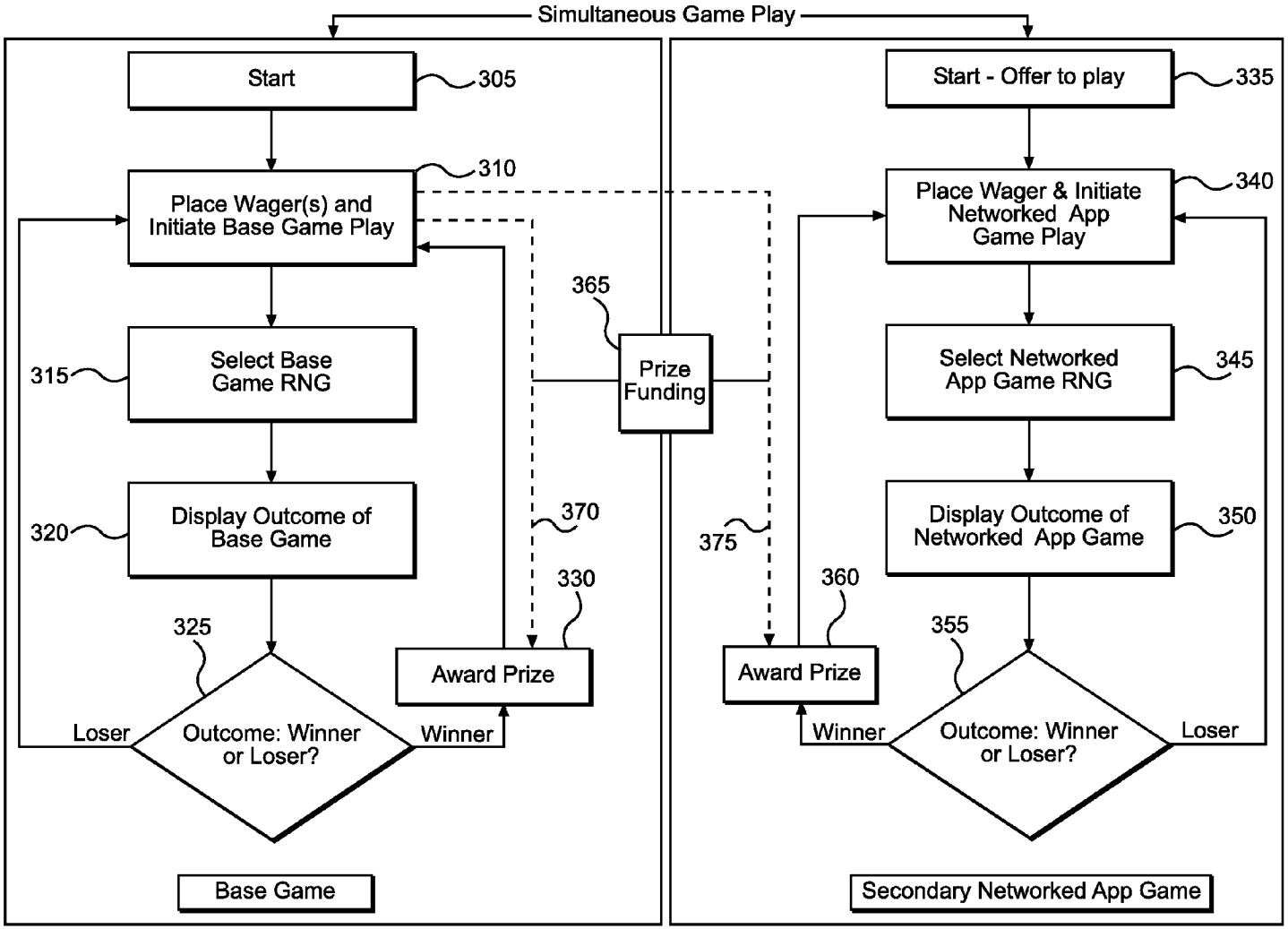
FIG. 3 shows a flow chart of game play on an electronic gaming machine with a base game and a secondary networked app game.

For the EGMs shown in FIGS. 1-2, the game play of the invention follows a sequence of steps shown in the flow chart of FIG. 3. The player begins at start 305 and places a wager 310 to initiate play of a base game on EGM 101. Once the wager is placed, a base game RNG is selected 315 and the corresponding outcome for the base game is displayed 320. The base game outcome may be either a winner or a loser and that determination is made at step 325. If it is a winner, the player is awarded the appropriate prize at step 330, usually in the form of credits added to a credit meter that is one of meters 117. In some games, a bonus round (not shown) is included where the player achieves certain winning combinations on the base game. In that case, the player moves on to play the bonus round. The player may win or lose in the bonus round and is again awarded a prize for winning. Once the award is made, the player is returned to the step of placing a wager 310.

In the event that the outcome of the base game is a loser, the player is not awarded a prize and is returned to the step of placing a wager 310 to begin a new base game.

During play of the base game as described, EGM 101 may offer the player an opportunity to play a secondary networked application game. The offer may come at any time during play of the base game. In one embodiment, the offer to play the secondary networked application game may happen after the player has won a base game or had a winning streak of a certain number of games on the base game. In another embodiment, the player is offered the opportunity to play the secondary networked application game after a loss or string of losses where the secondary networked app game provides the player with additional chances to win at a low "buy-in" or wager cost. For example, a secondary networked app game referred to as "Million Dollar Penny Bet™" ("MDPB") may permit a player to make a 1 cent bet to be eligible for a million dollar prize. For each spin (or other play) on the secondary networked app game, the player has a chance to win. The offer to play the secondary networked app game pops up on overlay screen 125 as represented at step 335. The player may place a wager and initiate the secondary networked app game play at step 340. If the player declines the offer in step 335, no further action is taken with respect to the secondary networked app game.

If the player accepts the offer to play the secondary networked app game, s/he does so by placing the necessary wager, either by inserting the appropriate amount in EGM 101 or agreeing to a deduction from credit meter 117. This action is represented at step 340. Once the wager is placed and play is initiated, EGM 101 selects a networked secondary app game RNG at step 345. The game ends and the outcome is displayed at step 350. A determination is made whether the game is a winner or loser at step 355. If it is a winner, the player is awarded a prize at step 360 and is then returned to start the game cycle for the secondary networked app game at step 340. If the game outcome is a loser, the player is returned to start the game cycle again at step 340 without being awarded a prize. It is also possible to include a bonus round in the secondary networked app game, although such a bonus round is not shown in the flowchart of FIG. 3.

The play of the base game and the secondary networked app game are conducted simultaneously on EGM 101 with the base game being displayed on display 105 and the secondary networked app game being displayed on overlay screen 125. During play, EGM 101 communicates with controller 121 to carry out each of the functional steps of the secondary networked app game while the controller of EGM 101 controls the game functions separately for the base game. It should be understood that controller 121 and EGM 101 are in functional communication to permit the handling of different functions that must be coordinated between EGM 101 and controller 121. For example, credits to be wagered on the secondary networked app game must be received by controller 121 from EGM 101. Similarly, controller 121 must communicate to EGM 101 any awards to be posted on credit meter 117 for a win on the secondary networked app game. Player tracking activity for the simultaneous play may also be reported through the EGM by communicating the information between controller 121 and EGM 101. Communication functions between EGM 101 and controller 121 are known to those skilled in the art and are available for use in the overlay screen products referenced herein.

It should also be understood that a base game and the secondary networked app game may be offered simultaneously on a general purpose computing device such as those shown in FIGS. 1B-F. In that case, the RNG may be run on the general computing device, or alternatively on server 221 that communicates with any individual general computing device to deliver game play outcomes and to handle other function such as wagers and payments to the player. A secure connection may be established to ensure that player identification information as well as any transaction involving funds using a credit card or other online payment technique are appropriately encrypted and protected. Server 221 performs the same functions as controller 121 in the environment to FIG. 2A and should be considered as an alternative wherever reference is made to controller 121 throughout this specification.

Wagers for the secondary networked app game are independent from the base game wagers. In one embodiment described above, a player places, for example, a 1 cent wager to be eligible for a million dollar prize. In such an embodiment, the 1 cent wager is not intended to fund the million dollar jackpot. Instead, funding for the million dollar jackpot comes from a contribution from each bet on the base games for EGMs 101 across the network, which may be, for example, 5%, even though the wager to be eligible for the secondary networked game app prize is only 1 cent. As is indicated in FIG. 3 at prize funding box 365 with reference to dotted funding arrows 370 and 375, funding for both the base game awards and the secondary networked app game awards come from the wagers placed on the base game. This configuration provides a higher theoretical payout percentage for the million dollar jackpot on the secondary networked app game than on the base game, thereby making the secondary networked app game a "good bet" and one that the players are excited to accept. Using the 5% contribution of handle on the base game to fund the secondary networked app game jackpot, the payout to players may be 90% on the base game, but 95% on the secondary networked app game.

Figure 4:
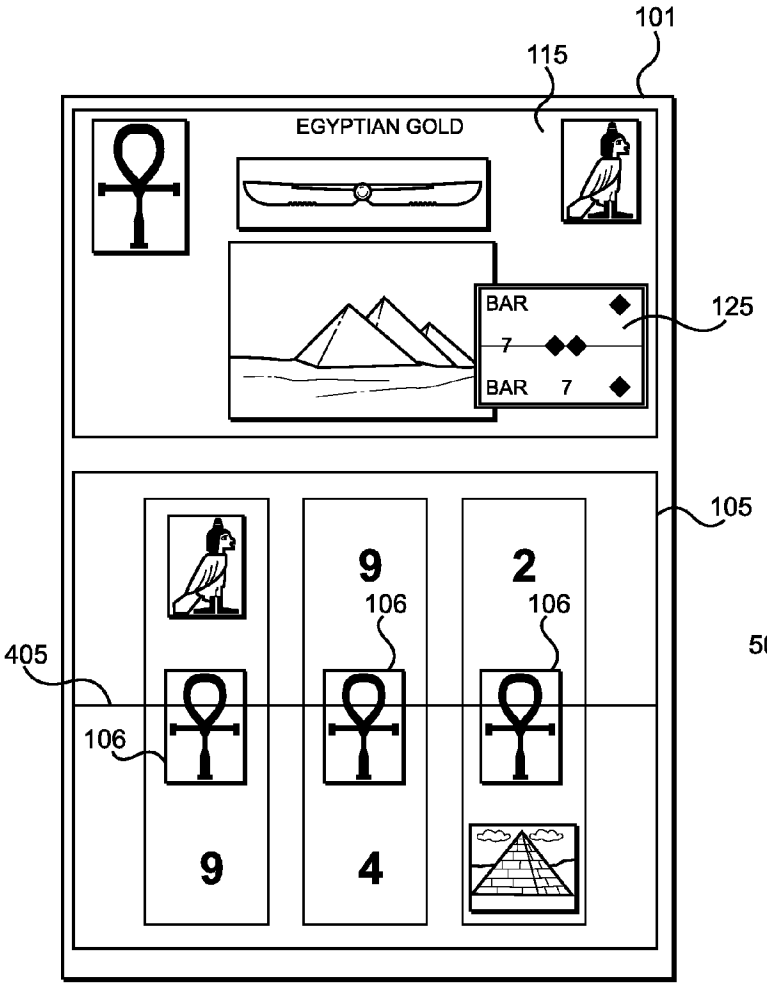
FIG. 4 shows displays on an electronic gaming machine with a base game and a secondary networked app game on an overlay screen on the top box display.

FIG. 4 shows a screen shot of display 105 and top box display 115 during play of a base game and a secondary networked application game on EGM 101. In FIG. 4, display screen 105 shows symbols 106 representing the outcome of a base game on EGM 101. Once play has ended, it is determined whether the player has won or lost. In the representative display shown in FIG. 4, the player has won by lining up three key symbols on pay line 405. In that case, the game ends, the player is awarded a prize, and the player may start again from the beginning by placing a wager for a new game.

During play of the base game, the player may also be offered an opportunity to participate in a secondary networked application game on top box display 115 which is a flat screen LCD. As can be seen in FIG. 4, an overlay screen 125 pops up in a portion of top box 115. Messages may be displayed inviting the player to participate in the secondary networked application game. Once an invitation is accepted by the player agreeing to place a separate wager, the secondary networked application game begins. Game play and other informational messages are displayed as is customary during the play of games. However, the pool of money for funding prizes awarded in the secondary networked application game is aggregated from wagers placed on the base game.

As already described herein, secondary networked application game is one in which multiple participants at EGMs across a casino or a larger network such as in a jurisdiction like the State of Nevada may participate. The awards that are available for winning outcomes on the secondary networked application game are funded by base game wagers on EGMs 101 connected to controller 121 on network 123. As an example, 5% of each base game wager is used to fund the secondary networked application game prize pool. This secondary game funding percentage may be higher than the funding for the base game to make the secondary game more appealing to players.

An example is a game referred to as Million Dollar Penny Bet. The player is asked if they would like to play the Million Dollar Penny Bet secondary game that makes them eligible for a million dollar jackpot. There is a wager required to play the secondary game (for example 1 penny per spin), which is initiated through overlay screen 125, yet is transferred from credit meter 117 on EGM 101.

Upon initiating the secondary networked application game through overlay screen 125, an event is initiated whereby a percentage of an amount wagered on the base game (sometimes referred to as "turnover" or "handle") is attributed towards the prize pool for the secondary networked application. The amounts are set at controller 121 and communicated between EGM 101 and controller 121 to ensure that all accounting is properly recorded in compliance with gaming regulations.

Should the player decide to accept the invitation to play 'Million Dollar Penny Bet,' then 1 cent of every spin (until the player indicates they no longer wish to play 'Million Dollar Penny Bet') comes off credit meter 117 and allows entry to the secondary networked application game.

At this point, an event occurs whereby controller 121 receives a signal from EGM 101 running the base game indicating turnover or handle, and a certain percentage of the primary game turnover or handle is attributed to the winning amount and resulting outcome based upon the controller or server triggering a winning event.

The wagered amount (in this example, 1 penny per spin) is not attributed towards the prize pool, it is simply a payment for the right to play the secondary game and is collected by the operator of EGM 101. All contribution of winnings are from the base game turnover ("handle") and are generated through controller 121, not EGM 101 running the base game.

The player benefits by betting a minimal amount to allow them to enter the secondary networked application game, yet all winnings are derived from the base game. This allows the player to perceive they are winning a considerable amount based upon betting a minimal amount, providing an extremely high return percentage compared to the bet that initiates the secondary game.

Figure 5:
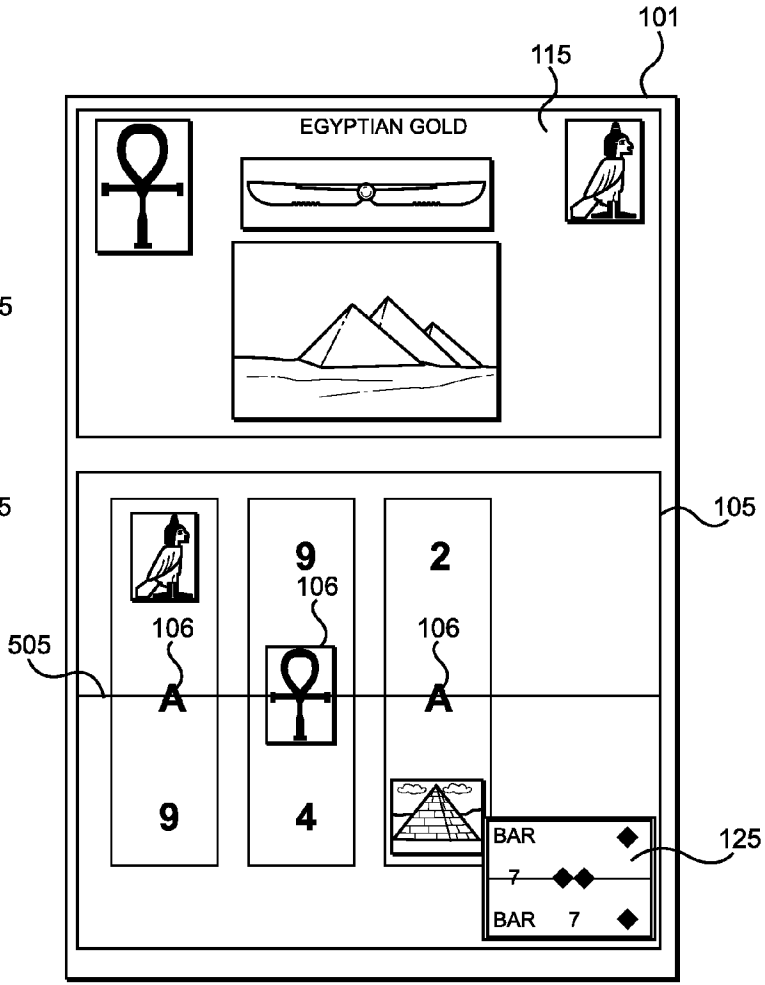
FIG. 5 shows displays of an electronic gaming machine with a base game and a secondary networked app game on an overlay screen on the main display.

FIG. 5 shows screen shots of an alternative embodiment of displays 105 and 115 on EGM 101 during play of a base game and a secondary networked application game respectively. In FIG. 5, display screen 105 shows symbols 106 representing the outcome of a base game on EGM 101 on payline 505. The screen shot of top box 115 shows a standard top box display for a game referred to as Egyptian Gold with imagery of Ancient Egypt that are also used as game symbols. All game functions and play of the secondary networked application game is on overlay screen 125 that appears inset in main display screen 105. It should be understood that overlay screen 125 could be positioned elsewhere within display screen 105 and that the positioning in FIG. 5 is just one example of placement.

For computing devices 171-179, all elements of the game are shown on the main display of the device with an inset PIP display for displaying the elements of the secondary networked application game. Otherwise, the simultaneous play of the base game and the secondary networked app game is the same as described with respect to FIG. 3.

While the invention has been described with respect to the figures, it will be appreciated that many modifications and changes may be made by those skilled in the art without departing from the spirit of the invention. For example, the secondary networked application game may be in the form of a wheel or other indicator instead of the standard video slot game shown in FIGS. 4 and 5. Any variation and derivation from the above description and drawings are included in the scope of the present invention as defined by the claims.

What is claimed is:

1. A gaming system including at least one electronic gaming machine ("EGM") connected to a network on which a player is engaged in play of a base game and a secondary networked application game concurrently, comprising:

a wager acceptor for receiving wagers from the player wherein the wager acceptor receives a base game wagers and a secondary networked application game wager that is of nominal value;

a base game random number generator ("RNG") for generating random numbers that determine the outcome of a base game and that correspond to a predefined set of game outcomes including winning and losing outcomes;

an EGM display for displaying game operation for the base game including game outcomes to a player based on the results of the base RNG;

a game controller for controlling game play functions on the EGM including providing awards to players for winning outcomes;

a base game played on the EGM wherein a player wagers an amount on the base game that funds both a winning outcome on the base game and a winning outcome on the secondary networked application game;

a network controller in communication with the EGM for conducting the secondary networked application game;

a network random number generator ("RNG") associated with the network controller for generating random numbers that determine the outcome of the secondary networked application game and that correspond to a predefined set of game outcomes including winning and losing outcomes, wherein the outcome of the secondary networked application game is determined independently of the outcome of the base game;

a secondary display window on the EGM for displaying game operations for the secondary networked application game including game outcomes to a player based on the results of the network RNG;

wherein the player is prompted during a session of play of the base game with an offer to play a secondary networked application game that occurs between a start time when an initial base game wager is placed and an end time when the player cashes out or has no credits left to play, and further wherein, acceptance by the player of the offer to play a secondary networked application game includes placing the secondary networked application game wager and initiatinges play of the secondary networked application game on the secondary display, and further wherein the offer to play the secondary networked application game is not dependent on a result of a particular game play outcome of the base game; and wherein a player is awarded for a winning outcome of the secondary networked application game.

2. The system of claim 1 wherein a theoretical payout percentage to players on the secondary networked application game is higher than a theoretical payout percentage to players on the base game.

3. The system of claim 1 wherein the secondary display window is displayed within the EGM display.

4. The system of claim 1 wherein the secondary display window is a separate display from the EGM display.

5. The system of claim 1 wherein the secondary networked application game is offered to the player upon completion of a predefined number of base games.

6. The system of claim 4 further wherein the predefined number of base games includes a predefined number of losing outcomes.

7. The system of claim 1 wherein the secondary networked application game wager is one cent.

8. A method of playing a base game and a secondary networked application game on a system including at least one electronic gaming machine ("EGM") with a game controller and a display in communication with a network controller, comprising:

placing a wager to initiate play of a base game on the EGM;

selecting a base game random number using the game controller that is converted to a base game outcome wherein the base game outcome is one of a plurality of outcomes in a predefined set including winning and losing outcomes;

determining whether the base game outcome is a winning outcome on the game controller;

displaying the base game outcome on the display;

providing the player a predefined award for a winning base game outcome wherein a winning base game outcome is funded by wagers on the base game;

prompting a player during a session of play of a base game with an offer to play a secondary networked application game on a secondary display wherein the session of play of the base game occurs between a start time when an initial base game wager is placed and an end time when the player cashes out or has no credits left to play;

accepting the offer to play the secondary networked application game by placing a secondary networked application game wager that is of nominal value;

in response to the player accepting the offer to play a secondary networked application game, initiating a play of the secondary networked application game on the secondary display wherein the secondary networked application game is conducted concurrently on the EGM during a session of play of the base game and further wherein an offer to play the secondary networked application game is not dependent on a result of a particular game play outcome of the base game;

selecting a secondary networked application game random number using the network controller that is converted to a secondary networked application game outcome wherein the secondary networked application game outcome is one of a plurality of outcomes in a predefined set including winning and losing outcomes, and wherein an outcome of the secondary networked application game is independent of a particular base game outcome on the base game;

displaying a secondary game outcome on a secondary display upon completion of the secondary networked application game; and providing the player a predefined award for a winning secondary networked application game outcome wherein a winning secondary networked application game outcome is funded by wagers on the base game.

9. The method of claim 8 further comprising aggregating base game wagers from a plurality of EGMs to form a prize pool from which the base game and secondary networked application game prizes may be funded.

10. The method of claim 8 wherein a theoretical payout percentage to players on the secondary networked application game is higher than a theoretical payout percentage to players on the base game.

11. The method of claim 8 wherein the secondary display is displayed within the base game display.

12. The system of claim 8 wherein the secondary networked application game is offered to the player upon completion of a predefined number of base games.

13. The system of claim 12 further wherein the predefined number of base games includes a predefined number of losing outcomes.

14. The method of claim 8 wherein the secondary networked application game wager is one cent.

15. A gaming system including a server in communication with at least one electronic gaming machine ("EGM") on a network wherein a player is engaged concurrently in a session of play of a base game on the EGM and a networked application game conducted over the network and displayed on the EGM, comprising:

a server comprising:

a server random number generator ("RNG") for generating random numbers that determine the outcome of a networked application game and that correspond to a predefined set of networked game outcomes including winning and losing outcomes; and a server controller for executing the server RNG and conducting a secondary networked application game wherein the outcome of the secondary networked application game is determined independently of the outcome of the base game; and an EGM comprising:

a wager acceptor for receiving wagers from the player wherein the wager acceptor receives base game wagers and secondary networked application game wagers of nominal value from the player and further wherein the base game wagers fund both a winning outcome on the base game and a winning outcome on the secondary networked application game;

a base game RNG for generating random numbers that determine the outcome of a base game from a predefined set of game outcomes including winning and losing outcomes;

an EGM controller for executing the base game RNG, controlling game play functions on the EGM including providing awards to players for winning outcomes for a base game and for communicating with the server controller such that the player engages in play of the networked application game at the EGM wherein the player is prompted during a session of play of a base game with an offer to play a secondary networked application game during a session of play of the base game that occurs between a start time when an initial base game wager is placed and an end time when the player cashes out or has no credits left to play, and further wherein, in response to the player accepting the offer to play a secondary networked application game by placing the secondary networked application game wager, initiating a play of the secondary networked application game on the secondary display wherein the secondary networked application game is conducted concurrently on the EGM during a session of play of the base game; and an EGM display for displaying a session of game play of the base game and the networked application game concurrently, including displaying base game outcomes and networked game outcomes to the player based on the results of the base game RNG and the server RNG, wherein the player is awarded for a winning outcomes for the base game and the networked application game, and further wherein a winning outcome on the base game and a winning outcome on the networked application game are funded by wagers on the base game.

16. The system of claim 15 wherein a theoretical payout percentage to players on the networked application game is higher than a theoretical payout percentage to players on the base game.

17. The system of claim 15 wherein the display includes viewing windows for separately displaying the base game and the networked application game simultaneously.

18. The system of claim 15 further comprising a second display for displaying the networked application game.

19. The system of claim 15 wherein the secondary networked application game is offered to the player upon completion of a predefined number of base games.

20. The system of claim 19 wherein the predefined number of base games includes a predefined number of losing outcomes.

21. The system of claim 15 wherein the secondary networked application game wager is one cent.

* * * * *